United States Patent [19]

Gompf et al.

[11] 3,938,995

[45] Feb. 17, 1976

[54] SILVER HALIDE COLOR PHOTOGRAPHIC ELEMENT AND PROCESS CONTAINING LEUCO DYES

[75] Inventors: Thomas Edward Gompf, Penfield; William Henry Faul, Rochester, both of N.Y.

[73] Assignee: Eastman Kodak Company, Rochester, N.Y.

[22] Filed: July 10, 1974

[21] Appl. No.: 487,083

[52] U.S. Cl. ..... 96/55; 96/100

[51] Int. Cl.[2] ..... G03C 7/00; G03C 1/40

[58] Field of Search ..... 96/100, 54, 66 R, 22, 55

[56] References Cited

UNITED STATES PATENTS

| | | | |
|---|---|---|---|
| 1,102,028 | 6/1914 | Fischer | 96/100 |
| 2,227,981 | 1/1941 | Schinzel | 96/100 |
| 3,185,567 | 5/1965 | Rogers | 96/3 |
| 3,342,597 | 9/1967 | Harnish et al. | 96/100 |
| 3,723,117 | 3/1973 | Willems | 96/66 |
| 3,770,437 | 11/1973 | Brugger et al. | 96/22 |

*Primary Examiner*—J. Travis Brown

*Attorney, Agent, or Firm*—M. R. Chipaloski

[57] ABSTRACT

Color photographic elements, compositions and processes for producing color negative images are described which employ a leuco dye comprising the reaction product of a color forming coupler and a N,N-dialkyl-p-phenylenediamine having an electronegative group attached to the benzene ring. The leuco dye is stable against aerial oxidation and can be developed to its corresponding dye with certain black and white developing compositions.

16 Claims, No Drawings

SILVER HALIDE COLOR PHOTOGRAPHIC ELEMENT AND PROCESS CONTAINING LEUCO DYES

FIELD OF THE INVENTION

This invention relates to photography and more particularly to color photography employing light-sensitive silver halide emulsion layers comprising a ballasted leuco dye which is the reaction product of a color-forming coupler and a deactivated N,N-dialkyl-p-phenylenediamine.

BACKGROUND OF INVENTION

In color photography the dye image is formed during a color developing process. The color developing agent, usually a N,N-dialkyl-p-phenylenediamine is oxidized in a reaction with silver halide producing free silver. Oxidized developing agent then reacts rapidly with a variety of organic molecules, called couplers, to form dyes. The color of the dye thus formed is determined by the generic structure of the coupler.

In the preparation of silver halide emulsions for recording colors, it is customary to incorporate a color forming material in the silver halide emulsion so that upon color development this color forming compound (coupler) reacts with the oxidation product of the developing agent to form a dye. In the typical format for recording the visible spectrum, the emulsion is coated in several layers, each sensitive to a particular region of the spectrum. By suitable control of the development and by use of several couplers, it is possible to form the proper dye in each layer to give an adequate color representation of the photographed scene or object.

The greatest sharpness in three simultaneously prepared color separations in permanently superimposed emulsions is obtained if the reduced silver, or the chemical components which are substituted in the place of the reduced silver or in the place of the residual silver halide or even better deposited during development — are employed in the color separations. To this end these chemical compounds must be insoluble or at least not easily diffusing and they, or the silver, must have reducing, oxidizing or catalytic properties. Therefore numerous methods of color photography are possible by means of triple or double emulsion layers containing the color generators from the beginning.

It has already been proposed for the production of color photographs to add leuco-dyes to a silver salt emulsion and to convert these into a particular color as a result of the interaction between the silver reduced upon development and the leuco-dyes, whereby the locally deposited quantity of silver in the developed picture determines the degree of color formation for every point in the sensitized layer. Problems arise in the reduction of this proposal to practice due to the inherent oxidative instability of the leuco-dyes. Common leuco-dyes incorporated in sensitized layers of a film generally oxidize on keeping and cause indiscriminate dye formation.

OBJECTS OF THE INVENTION

It is therefore an object of this invention to provide a stable leuco-dye which may be incorporated into a sensitized silver halide layer.

It is another object of this invention to provide a multi-color photographic element in which each color image is formed in a sensitized silver halide layer comprising a leuco-dye which upon oxidiation by the reaction products of a silver halide developer forms said color image.

It is a further object of this invention to provide a novel method for the production of photographic dye images in which conventional color development is not required.

These and other objects are achieved by our invention which is described hereinafter.

SUMMARY OF THE INVENTION

A photosensitive element according to the present invention comprises a support having thereon at least one photosensitive silver halide emulsion layer having associated therewith a stabilized ballasted leuco dye which comprises the reaction product of a color forming coupler and a N,N-dialkyl-p-phenylenediamine group having an electronegative group attached to the benzene ring. The electronegative group is of such character that when attached to the benzene ring of the p-phenylenediamine moiety, said electronegative group is sufficiently electron withdrawing to stabilize the leuco dye against aerial oxidation.

According to the present invention, a preferred method of forming a color negative image comprises (1) forming a black-and-white and dye image on an imagewise exposed photosensitive photographic element containing silver halide by contacting said exposed silver halide element (as described above) with a cross-oxidizing developing composition, and (2) removing silver and silver halide with a bleach-fix solution to leave a dye image in the exposed areas.

The above-described leuco dye may be represented by the following formula:

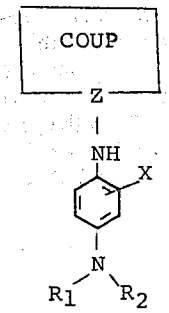

I where

COUP — represents a ballasted cyan-dye-forming coupler moiety;

Z — denotes the coupling site of the coupler moiety;

$R_1$ and $R_2$ — each represents a lower alkyl group (preferably of one to six carbon atoms) or a substituted lower alkyl group such as hydroxyalkyl, alkoxyalkyl, carboxyalkyl, sulfoalkyl and haloalkyl; and X — represents at least one electronegative group having the capability of deactivating the p-phenylenediamine group sufficiently to stabilize the leuco dye molecule against aerial oxidation.

Other objects and advantages of the invention will become apparent to those skilled in the art of color photography upon consideration of the accompanying disclosure.

DETAILED DESCRIPTION OF THE INVENTION

Stable cyan-dye-forming leuco dyes of the present invention can be represented, for example, by the following formula:

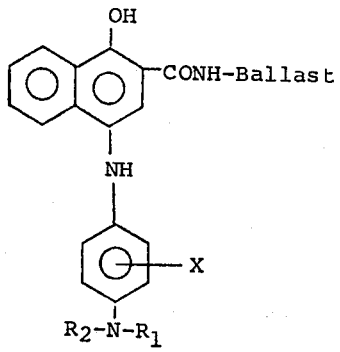

II wherein X, $R_1$ and $R_2$ are the substituents defined above and Ballast is an organic radical of such molecular size and configuration as to render the leuco dye nondiffusible during storage and development.

An important feature of the novel leuco dyes is the presence of the deactivating group X on the benzene ring of the phenylenediamine portion of the molecule. It is this deactivating group which imparts the stability (i.e., resistance to aerial oxidation) required of these compounds during their storage before and after incorporation in the silver halide emulsion layer of the photographic element.

The deactivating group is an electronegative or electron withdrawing group which has sufficient electron withdrawing potential to stabilize the leuco dye against aerial oxidation. Any such group or combination of such groups sufficient to stabilize the leuco dye molecule is contemplated. Examples of such electronegative or electron withdrawing groups useful in the practice of the present invention include: $-NO_2$; $-CN$; $-CF_3$; $-F$; $-COR^1$; $-COOR^1$; $-SO_2R^1$; $-SO_2R^{11}$; and

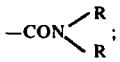

wherein R is a hydrogen atom or $R^1$, $R^1$ is a lower alkyl radical or substituted lower alkyl radical, and $R^{11}$ is an aryl radical or a substituted aryl radical.

Other color forming couplers, COUP in formula I above, which are useful in forming leuco dyes for the practice of the present invention can be any of the cyan-dye-forming coupler moieties well known to those skilled in the art of color photography. Included among such coupler moieties are the phenolic and naptholic couplers described in the following patents: Porter et al, U.S. Pat. No. 2,295,009 issued Sept. 8, 1942; Salminen et al, U.S. Pat. No. 2,367,531 issued Jan. 16, 1945; Salminen et al, U.S. Pat. No. 2,423,730 issued July 8, 1947; Weissberger et al, U.S. Pat. No. 2,474,293 issued June 28, 1949; Salminen et al, U.S. Pat. No. 2,772,162 issued Nov. 27, 1956; Salminen et al, U.S. Pat. No. 2,895,826 issued July 21, 1959; Bush et al, U.S. Pat. No. 2,920,961 issued Jan. 12, 1960; Vittum et al, U.S. Pat. No. 3,002,836 issued Oct. 3, 1961; Kodak Limited, British Pat. No. 503,752 issued Apr. 11, 1939; Kodak Pathe, French Pat. No. 836,144 issued Jan. 11, 1939; Merckx et al, U.S. Pat. No. 2,197,311 issued Apr. 16, 1940; Fröhlick et al, U.S. Pat. No. 2,357,395 issued Sept. 5, 1944; Thompson, U.S. Pat. No. 2,498,466 issued Feb. 21, 1950; de Ramaix et al, U.S. Pat. No. 3,013,879 issued Dec. 19, 1961; Stecker, U.S. Pat. No. 3,041,236 issued June 26, 1962; de Ramaix et al, U.S. Pat. No. 3,047,385 issued July 31, 1962; Van Poucke et al, U.S. Pat. No. 3,079,256 issued Feb. 26, 1963; Schulte et al, U.S. Pat. No. 3,244,520 issued Apr. 5, 1966; Kendall et al, British Pat. No. 519,208 issued Mar. 19, 1940; Gevaert Photo-Producten N.V., British Pat. No. 969,921 issued Sept. 16, 1964; Gevaert Photo-Producten N.V., British Pat. No. 975,928 issued Nov. 25, 1965; Agfa Aktiengesellschaft, British Pat. No. 1,011,940 issued Dec. 1, 1965; Societa per Azioni Ferrania, British Pat. No. 1,111,554 issued May 1, 1968; Gevaert Photo-Producten, French Pat. No. 1,299,481 issued June 12, 1962; and Gevaert Photo-Producten N.V., French Pat. No. 1,308,760 issued Oct. 1, 1962. In addition cyan-dye-forming phenolic and naphtholic couplers are described by W. Pelz in an article entitled "FARBKUPPLER-EINE LITERATURÜEBERSICHT," published in Agfa Mitteilungen, Band II, pp. 156–175, and are not illustrated in Table XXIV on page 595 of "THE THEORY OF THE PHOTOGRAPHIC PROCESS," by C. E. K. Mees — Revised Edition, 1954.

It should be noted that the concept of this invention includes the modifications necessary to produce similar yellow- and magenta dye-forming leuco dyes. In such case COUP in formula I would represent a yellow- or magenta- dye-forming coupler moiety.

The nature of the ballast group in the formula for the leuco dyes described above (Ballast) is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

In a preferred embodiment of the present invention, a color negative can be formed by the method described in the Summary above. Any silver halide developing composition can be employed in our invention as long as it comprises a cross-oxidizing developing agent which will cross-oxidize with the leuco dye described herein. Such a silver halide developer, called a cross-oxidizing developing agent herein, becomes oxidized during development by reducing exposed silver halide to silver metal. The oxidized developer then cross-oxidizes the leuco dye, thereby forming a dye image in exposed areas.

A cross-oxidizing developing agent (COD) enables a color imaging precursor, such as the leuco dye herein, to become oxidized without the color imaging precursor itself developing silver. It can be viewed as an electron transfer agent which shuttles electrons between the developing silver halide and the color imaging precursor. The general definition can be written schematically as follows:

1.* $COD_{Red} + Ag^+ \rightleftharpoons COD_{ox} + Ag^\circ$

2) $COD_{ox}$ + Color Imaging Precursor$_{Red}$ $\rightleftharpoons$ $COD_{Red}$ + Color Imaging Precursor$_{ox}$

* Subscript "Red" denotes reduced form and "ox" denotes oxidized form.

The color imaging precursor is any chemical compound which, when oxidized, becomes a material which differs from the precursor in some way (absorption, chemistry, etc.) that can be exploited for imaging.

The color imaging precursor is frequently immobilized in an oil phase, and so a more specific scheme for the formation of a cross-oxidizing developing agent is as follows:

3. $COD_{Red}(H_2O) + Ag^+ \rightleftharpoons COD_{ox}(H_2O) + Ag^\circ$
4. $COD_{ox}(H_2O) \rightleftharpoons COD_{ox}(Oil)$ 5) $COD_{ox}$ (Oil) + Color Imaging Precursor$_{Red\ (Oil)}$ $\rightleftharpoons$ $COD_{Red\ (Oil)}$ + Color Imaging Precursor$_{ox\ (Oil)}$ 6. $COD_{Red}(Oil) \rightleftharpoons COD_{Red}(H_2O)$ Therefore, the requirement for a cross-oxidizing developing agent in the most general cases (eq. 1 and 2) are:

a. It must have sufficient electrochemical potential under the experimental conditions to develop exposed silver halide.
b. In its oxidized form it must be of such electrochemical potential as to oxidize the color imaging precursor.
c. In its oxidized form it must be stable to decomposition by other chemical reactions long enough to undergo the redox reaction with the color imaging precursor.

A further requirement for the specific system represented by equations 3–6 are:

d. The oxidized form must have high solubility in the oil phase since extensive partitioning into the oil phase is required.

If any of the conditions b, c, or d is not met, the developing agent is not a cross-oxidizing developing agent. This is to say, whether a developing agent is cross-oxidizing or not depends upon whether the oxidized form is sufficiently stable, sufficiently soluble in the oil phase (when one is present) and of an oxidizing potential such that an effective transferral of electrons can occur through whatever phase barriers exist during cross-oxidizing development.

It should be recognized that whether a particular developing agent meets the requirements of a cross-oxidizing developing agent as described above may depend upon the conditions under which development occurs. Other components in the developing composition, the pH of the developing composition, the temperature of the development process, the length of development time, etc. can all affect whether the requirements for a cross-oxidizing developing agent are met. Any developing agent which meets the requirements of a cross-oxidizing developing agent under development conditions can be used in the practice of this invention. Illustrative examples of developing agents which may be useful as cross-oxidizing developing agents in practicing this invention and also preferred cross-oxidizing agents are 1-phenyl-3-pyrazolidone (Phenidone), 1-phenyl-4,4-dimethyl-3-pyrazolidone (Dimezone), and 4-hydroxymethyl-4-methyl-1-phenyl-3-pyrazolidone (MOP).

An important feature of the processing cycle by which image dyes are produced from the leuco dyes described above is the removal from the photographic element of the developed silver and any residual silver halide in such a way that the leuco dyes will not be oxidized in the areas of the photographic element where they are to remain colorless (i.e. in the originally unexposed or partially exposed areas). Since the potent oxidizing capability of a conventional solution of a bleach such as potassium ferricyanide or ferric chloride could convert by oxidation, to visible dye the leuco dye molecules in the areas not already fully developed to visible dye by the cross-oxidizing development step, a ferricyanide or ferric chloride bleach followed by a fix is not preferred. The relatively mild oxidizing medium of conventional bleach-fix solutions, however, will not detrimentally affect the leuco dyes in the areas of the photographic element where they are to remain colorless. Useful bleach solutions are those having an oxidizing potential such that they will not oxidize the leuco dye in the unexposed or partially exposed areas of the element. It is preferred however to use a single bleach-fix bath in the processing cycle since generally the bleach-fix solution provides a mild oxidizing medium suitable for the practice of this invention. Suitable bleach-fix baths include, for example, solutions of sodium or ammonium thiosulfate with complexes of trivalent iron and ethylenediamine tetraacetic acid (EDTA).

The silver halide emulsions useful in our invention are well-known to those skilled in the art and are described in *Product Licensing Index*, Vol. 92, December, 1971, publication 9232, p. 107, paragraph I, "Emulsion types"; they may be chemically and spectrally sensitized as described on p. 197, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, " Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, XVIII, "Coating procedures", of the above article, the disclosures of which are hereby incorporated by reference.

The following examples further illustrate the invention.

EXAMPLE 1

Preparation of Compound 1 (Control)

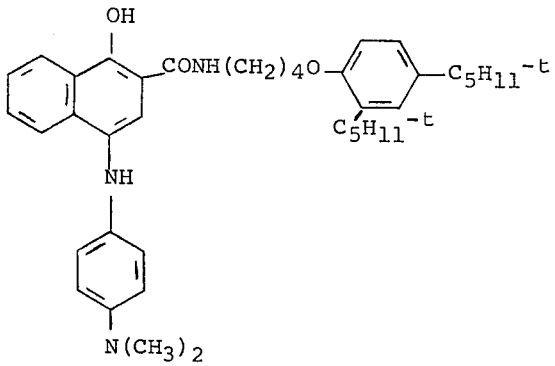

Compound 1

A solution of 37.4 g (0.22 mole) of silver nitrate in 200 ml water was added with rapid stirring over 30 seconds to a solution of 0.3 g gelatin and 14.6 g (0.29 mole) of sodium chloride in 200 ml of water. To the resulting slurry were added successively 17.1 g (0.138 mole) of sodium carbonate monohydrate in 100 ml water, 12 g (0.025 mole) of 2-[4-(2,4-di-tert-amylphenoxy) butylcarbamyl]-1-naphthol in a mixture of 100 ml of ethanol and 200 ml ethyl acetate, and 5.5 g (0.026 mole) of 4-amino-N,N-dimethylaniline dihydrochloride in 100 ml of water. The mixture was stirred at ambient temperature for 30 minutes, allowed to separate and the ethyl acetate layer removed. This was washed with water, dried ($MgSO_4$) and the solvent stripped off in vacuo. The residue was chromatographed on silica gel developing with ethyl acetate-hexane. The desired dye was removed and recrystallized from hexane-benzene to yield 2.8 g, mp 122.5°–124°.

Anal. Calcd. for $C_{39}H_{49}N_3O_3$: C, 77.06; H, 8.13; N, 6.91 Found: C, 77.1; H, 7.8; N, 6.9.

The previously prepared dye was reduced over Raney Nickel in THF to yield a solid that could be recrystallized from hexane. It was cream colored at first but rapidly turned cyan from aerial oxidation as it was dried.

Compound 1 had mp 75°–77°.

Anal. Calcd. for $C_{39}H_{51}N_3O_3$: C, 76.81; H, 8.43; N, 6.89. Found: C, 76.6; H, 8.1; N, 7.0.

EXAMPLE 2

Preparation of Compound 2

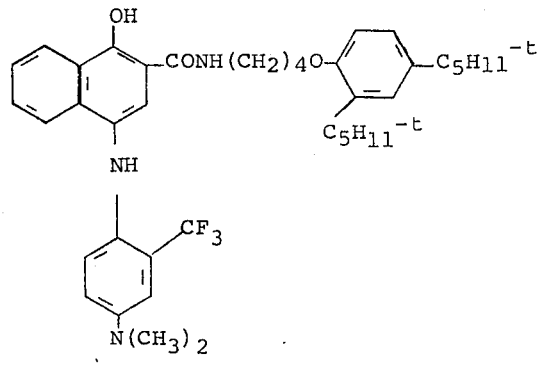

Compound 2

A sample of 3-trifluoromethyl-4-nitro-N,N-dimethylaniline (11.7 g, 0.05 mole) in 90 ml of ethyl acetate and 20 ml of ethanol was reduced with hydrogen over a Raney Nickel catalyst. The catalyst was filtered off and washed with ethyl acetate. The filtrate and washings were added to a mixture of 23.8 g (0.05 mole) of 2-[4-(2,4-di-tert-amylphenoxy) butylcarbamyl]-1-naphthol and 21 g (0.15 mole) of potassium carbonate in 1 liter of ethyl acetate and 600 ml of water. With rapid stirring, a solution of 65.8 g (0.2 mole) of potassium ferricyanide in 1700 ml water was added over 45 minutes. The solution was stirred for 15 minutes longer, allowed to separate, and the ethyl acetate layer removed. This was dried ($MgSO_4$) and the solvent stripped off in vacuo. The residual gum was crystallized from acetonitrile and then recrystallized three times to yield 7.4 g of dye, mp 122°–123°.

The dye was reduced in THF over Raney Nickel to yield a cream-colored solid, mp 98°–101° after recrystallization from hexane.

Anal. Calcd. for $C_{40}H_{50}N_3O_3F_3$: N, 6.20; F, 8.40 Found: N, 6.1; F, 8.3.

Compound 2 was considerably more stable towards aerial oxidation than Compound 1.

EXAMPLE 3

Preparation of Compound 3

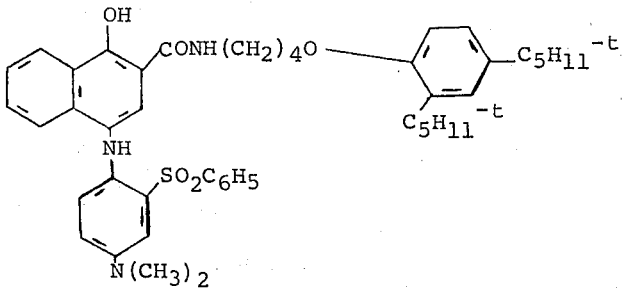

Compound 3

In a fashion similar to Compound 2, Compound 3 was prepared from 4-amino-3-phenylsulfonyl-N,N-diamethylaniline and 2-[4-(2,4-di-tert-amylphenoxy)-butylcarbamyl]-1-naphthol. The dye had mp 128°–132°.

Anal. Calcd. for $C_{45}H_{53}N_3SO_5$: C, 72.26; H, 7.14; N, 5.62; S, 4.29 Found: C, 72.0; H, 7.4; N, 5.5; S, 4.2

Compound 3 had mp 133°–136°.

Anal. Calcd. for $C_{45}H_{55}N_3SO_5$: C, 72.06; H, 7.39; N, 5.60; S, 4.28 Found: C. 71.9; H, 7.7; N, 5.6; S, 4.2.

EXAMPLE 4

Preparation of Compound 4

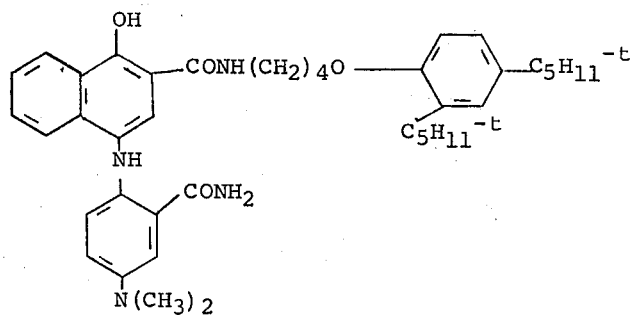

Compound 4

In a fashion similar to compound 2, compound 4 was prepared from 4-amino-3-carbamyl-N,N-dimethylaniline and 2-[4-(2,4-di-tert-amylphenoxy)butylcarbamyl]-1-naphthol.

The dye had mp 167°–169°.

Anal. Calcd. for $C_{40}H_{48}N_4O_3$: N, 8.60 Found: N, 8.8; 8.9.

Compound 4 had mp 145°–150°.

Anal. Calcd. for $C_{40}H_{50}N_4O_3$: C, 73.7; H, 8.03; N, 8.6 Found: C, 73.8; H, 8.1; N, 8.8.

EXAMPLE 5

A sample of a supported single-layer gelatinous silver halide emulsion coating containing per square foot of coating 108 mg silver, 400 mg gelatin and 152 mg of the leuco dye, Compound 1, dissolved in 152 mg di-(2-ethylhexoate)-1,4-cyclohexanediol, was exposed for 1/5 sec. through a graduated-density test object and then processed in the following sequence:

| | |
|---|---|
| Development* | 10 min. |
| Stop-Fix (Kodak F-5) | 5 min. |
| Wash | 5 min. |
| Bleach-Fix** | 5 min. |
| Wash | 5 min. |
| Drying | |
| $NH_4FeEDTA$ | 90 ml of 1.56 molar solution |
| $(NH_4)_2S_2O_3$ | 125 ml of a 60% solution |
| $Na_2SO_3$ | 12 g |
| $H_2O$ to 1 liter | (pH 6.5–6.8) |

*The developing solution consists of a solution of 0.2 g of 4-hydroxymethyl-4-methyl-1-phenyl-3-pyrazolidone in 1 liter of water, buffered at pH 12.
**Composition of bleach-fix solution:

The reproduced image consists of an overall cyan dye (i.e., Dmin ≈ Dmax) whose density at the wavelength of 647 nm was 2.61.

This result shows that the unstabilized leuco dye, Compound 1, was not operable within the scope of this invention.

EXAMPLE 6

A repeat of the procedures described in Example 5 with two other photographic elements wherein compound 1 was replaced with equimolar quantities of compounds 2 and 3 respectively lead to useful images.

Similar results were produced by varying the time of black-and-white development from 3 to 10 minutes.

Unlike in Example 5 where the exposed and developed element containing the control, an unstabilized leuco dye, had the same dye density in all areas, the results in Example 6, where stabilized leuco dyes were used, showed that a useable dye image, with density related to the amount of exposure, was obtained.

EXAMPLE 7

The processed sample containing leuco dye, compound 3, was subjected to a 7-day heat fading test (140°F/70% RH). The minimum (Dmin) and maximum (Dmax) densities of the cyan image (read through a Status A red filter) were recorded in the table below.

| Keeping Time | Dmin | Dmax |
|---|---|---|
| 0 Days | 0.20 | 2.26 |
| 2 Days | 0.21 | 2.26 |
| 5 Days | 0.22 | 2.26 |
| 7 Days | 0.23 | 2.26 |

The recorded data show the excellent stability of the dye image, especially in regard to its minimum density, produced from leuco dye compound 3 of this invention.

The invention has been described with particular reference to certain preferred embodiments thereof, but it will be understood that variations and modifications can be effected within the spirit and scope of the invention.

We claim:

1. A color photosensitive element comprising a support having thereon at least one photosensitive silver halide emulsion layer containing a stabilized ballasted leuco dye represented by the following general formula:

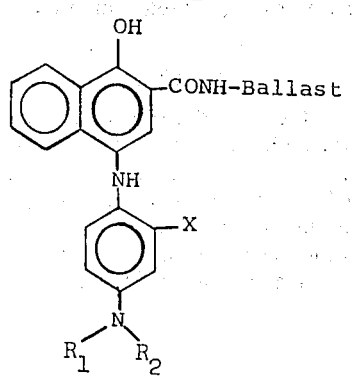

where

Ballast — represents an organic radical of such molecular size and configuration as to render said leuco dye nondiffusible during development;

$R_1$ and $R_2$ — each represent an alkyl group of one to six carbon atoms; and

X — is selected from the group consisting of $-CF_3$, $-SO_2C_6H_5$, and $-CONH_2$.

2. The color photosensitive element of claim 1, wherein the stabilized ballasted leuco dye is

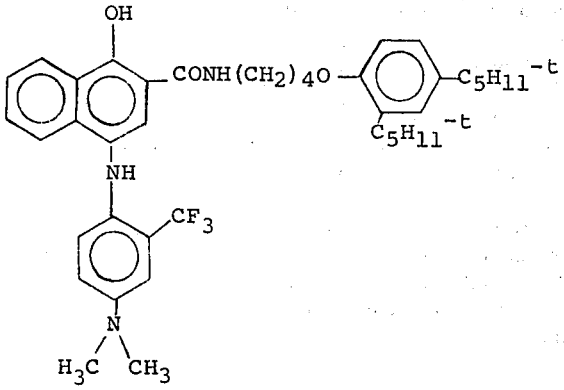

3. The color photosensitive element of claim 1 wherein the stabilized ballasted leuco dye is

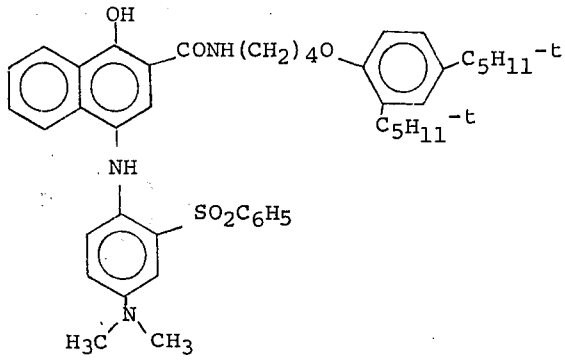

4. The color photosensitive element of claim 1 wherein the stabilized ballasted leuco dye is

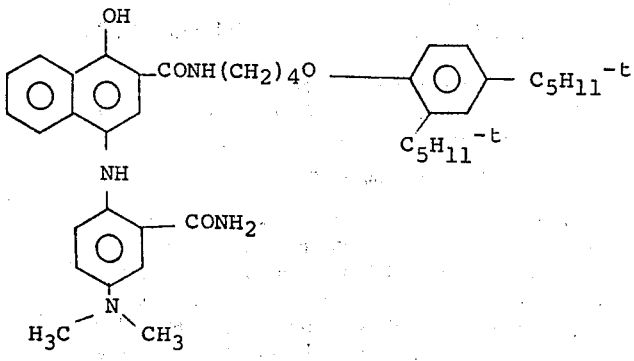

5. A method of forming a negative color image which comprises:

1. concurrently developing a silver and a dye image in the imagewise exposed areas of a photosensitive photographic element comprising a support having thereon at least one photosensitive silver halide emulsion layer containing a stabilized ballasted leuco dye which comprises the reaction product of a cyan color-forming coupler and a N,N-dialkyl-p-phenylenediamine having an electronegative group attached to the benzene ring, said electronegative group having the capability of deactivating the p-phenylenediamine group sufficiently to stabilize the leuco dye molecule against aerial oxidation;

and 2. removing developed silver and residual silver halide to leave a cyan dye image in the imagewise exposed areas of said layer without oxidizing the leuco dye molecules in the non-exposed areas of said layer.

6. The method of claim 5 wherein the stabilized ballasted leuco dye is of the formula:

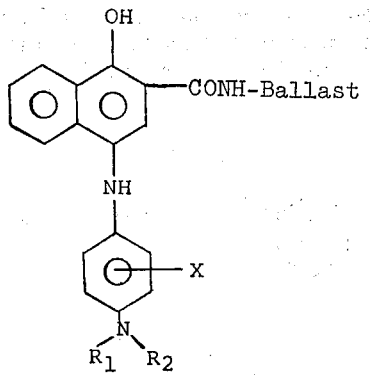

where

Ballast — represents an organic radical of such molecular size and configuration as to render said leuco dye nondiffusible during storage and development $R_1$ and $R_2$ — each represent a lower alkyl group or a substituted lower alkyl group; and X — represents at least one electronegative group having the capability of deactivating the p-phenylenediamine group sufficiently to stabilize the leuco dye molecule against aerial oxidation.

7. The method of claim 5 wherein the stabilized ballasted leuco dye is of the formula:

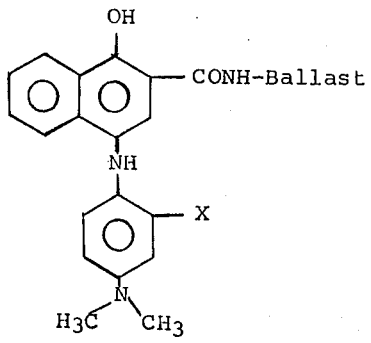

where

Ballast — represents an organic radical of such molecular size and configuration as to render said leuco dye nondiffusible during storage and development; and X — is selected from the group consisting of $-CF_3$, $-SO_2C_6H_5$, and $-CONH_2$.

8. The method of claim 5 wherein the stabilized ballasted leuco dye is of the formula:

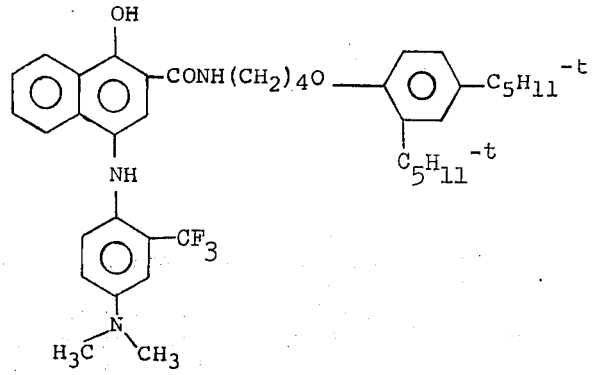

9. The method of claim 5 wherein the stabilized ballasted leuco dye is of the formula:

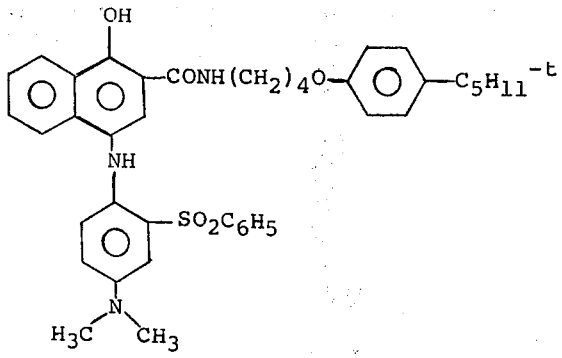

10. The method of claim 5 wherein the stabilized ballasted leuco dye is of the formula:

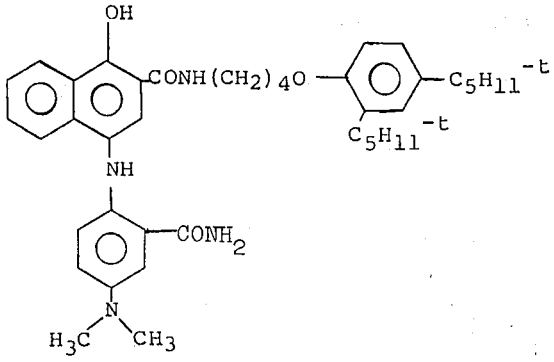

11. A method of forming a negative color image which comprises:

1. forming a silver and dye image in the imagewise exposed areas of a photosensitive photographic element comprising a support having thereon at least one photosensitive silver halide emulsion layer containing a stabilized ballasted leuco dye which comprises the reaction product of a cyan color-forming coupler and a N,N-dialkyl-p-phenylenediamine having an electronegative group attached to the benzene ring, said electronegative group having the capability of deactivating the p-phenylenediamine group sufficiently to stabilize the leuco dye molecule against aerial oxidation by contacting said exposed element with a developing composition containing a developing agent selected from the group consisting of 1-phenyl-3-pyrazolidone, 4-phenyl-4,4-dimethyl-3-pyrazolidone and 4-hydroxymethyl-4-methyl-1-phenyl-3-pyrazolidone; and
2. removing developed silver and residual silver halide with a bleach-fix solution to leave a cyan dye image in the imagewise exposed areas of said layer.

12. The method of claim 11 wherein the stabilized ballasted leuco dye is of the formula:

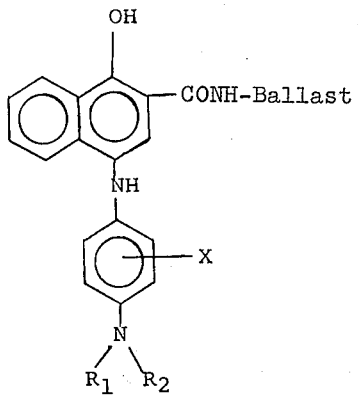

where

Ballast — represents an organic radical of such molecular size and configuration as to render said leuco dye nondiffusible during storage and development $R_1$ and $R_2$ — each represent a lower alkyl group or a substituted lower alkyl group; and X — represents at least one electronegative group having the capability of deactivating the p-phenylenediamine group sufficiently to stabilize the leuco dye molecule against aerial oxidation.

13. The method of claim 11 wherein the stabilized ballasted leuco dye is of the formula:

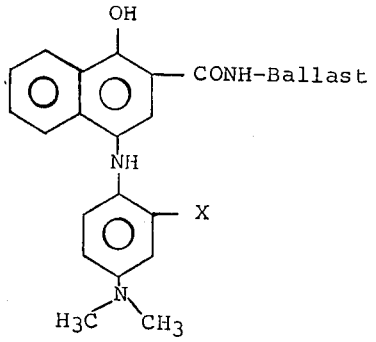

where

Ballast — represents an organic radical of such molecular size and configuration as to render said leuco dye nondiffusible during storage and development; and X — is selected from the group consisting of $-CF_3$, $-SO_2C_6H_5$, and $-CONH_2$.

14. The method of claim 11 wherein the stabilized ballasted leuco dye is of the formula:

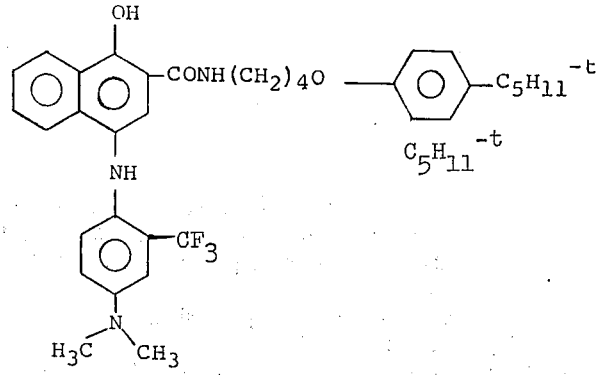

15. The method of claim 11 wherein the stabilized ballasted leuco dye is of the formula:
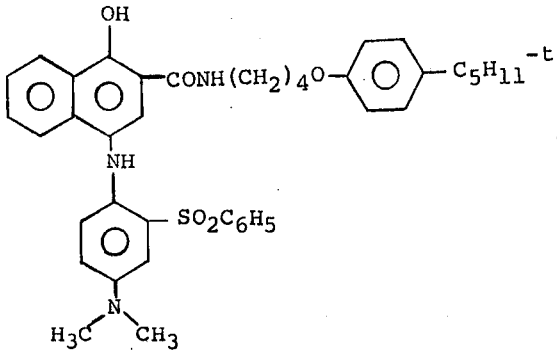
16. The method of claim 11 wherein the stabilized ballasted leuco dye is of the formula:
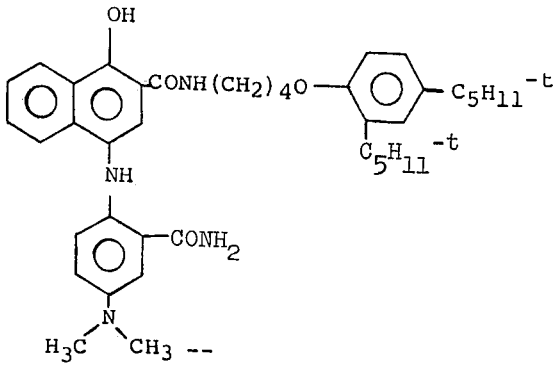
* * * * *